US008677700B2

(12) United States Patent
Fairbairn et al.

(10) Patent No.: US 8,677,700 B2
(45) Date of Patent: Mar. 25, 2014

(54) FOUNDATION SYSTEM FOR ELECTRICAL UTILITY STRUCTURES

(71) Applicant: Thomas & Betts International, Inc., Wilmington, DE (US)

(72) Inventors: Mark Fairbairn, Red Wing, MN (US); Aubrey Jackson, Collierville, TN (US); Ed Jacobs, Germantown, TN (US); Steve Moline, Pepin, WI (US); Thad Mumm, Wahoo, NE (US); Jim Palmer, Arlington, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 13/751,697

(22) Filed: Jan. 28, 2013

(65) Prior Publication Data

US 2013/0227898 A1 Sep. 5, 2013

Related U.S. Application Data

(60) Provisional application No. 61/605,517, filed on Mar. 1, 2012.

(51) Int. Cl.
*E02D 27/00* (2006.01)

(52) U.S. Cl.
USPC ..... 52/169.9; 52/157; 248/523

(58) Field of Classification Search
USPC ..... 52/169.9, 155–157, 295, 296, 745.15, 52/745.17, 745.18; 248/519, 523, 530, 248/156, 188.7
See application file for complete search history.

(56) References Cited

U.S. PATENT DOCUMENTS

| | | | | | |
|---|---|---|---|---|---|
| 1,689,050 | A | * | 10/1928 | Rawley | 52/152 |
| 1,722,352 | A | * | 7/1929 | Rawley | 52/152 |
| 3,011,597 | A | | 12/1961 | Galloway et al. | |
| 3,185,423 | A | * | 5/1965 | Jones, III | 248/188.3 |
| 3,342,444 | A | | 9/1967 | Nelson | |
| 3,969,853 | A | | 7/1976 | Deike | |
| 4,650,372 | A | | 3/1987 | Gorrell | |
| 4,714,225 | A | * | 12/1987 | Skinner et al. | 248/523 |
| 4,803,812 | A | | 2/1989 | Alexander, Sr. | |
| 5,575,593 | A | | 11/1996 | Raaf | |

(Continued)

FOREIGN PATENT DOCUMENTS

| | | |
|---|---|---|
| CA | 2549993 | 12/2007 |
| GB | 2465030 | 5/2010 |

OTHER PUBLICATIONS http://ir-on.su/vintovye-svai/istoriya-vintovyx-svaj/ - see photo _MG_1609_b_transmission_distribution_d-428x0.

*Primary Examiner* — Jeanette E Chapman
*Assistant Examiner* — Daniel Kenny
(74) *Attorney, Agent, or Firm* — G. Andrew Barger; Robbie E. Webb

(57) ABSTRACT

A foundation system for electrical utility structures is provided that minimizes impact on the chosen construction site, minimizes labor and minimizes associated installation costs. The foundation system comprises a structure to be supported at its base which has a plurality of arm members secured to the base and a plurality of helical piers or micropiles which are inserted into the ground and distally attached to the base of the structure by attaching to the arm members.

3 Claims, 12 Drawing Sheets

(56) References Cited

U.S. PATENT DOCUMENTS

| | | | | |
|---|---|---|---|---|
| 5,586,417 | A | 12/1996 | Henderson et al. | |
| 5,683,207 | A | 11/1997 | Mauer | |
| 5,707,180 | A | 1/1998 | Vickars et al. | |
| 5,826,387 | A | 10/1998 | Henderson et al. | |
| 5,960,597 | A | 10/1999 | Schwager | |
| 6,202,368 | B1 | 3/2001 | Wallace, III | |
| 6,298,611 | B1 | 10/2001 | Oliver et al. | |
| 6,352,390 | B1 | 3/2002 | Jones | |
| 6,390,435 | B1 * | 5/2002 | Gustafsson | 248/519 |
| 6,615,554 | B2 | 9/2003 | Rupiper | |
| 6,652,195 | B2 | 11/2003 | Vickars et al. | |
| 6,659,692 | B1 | 12/2003 | May | |
| 6,665,990 | B1 | 12/2003 | Cody et al. | |
| 6,814,525 | B1 | 11/2004 | Whitsett | |
| 6,872,031 | B2 | 3/2005 | May | |
| 7,044,686 | B2 | 5/2006 | May | |
| 7,059,095 | B1 | 6/2006 | Stevens et al. | |
| 7,090,437 | B2 | 8/2006 | Pinkleton | |
| 7,165,915 | B2 | 1/2007 | Queen | |
| 7,195,426 | B2 | 3/2007 | May | |
| 7,267,510 | B2 | 9/2007 | Dimitrijevic | |
| 7,416,367 | B2 | 8/2008 | St. Onge et al. | |
| 7,436,084 | B2 | 10/2008 | Wobben | |
| 7,470,090 | B2 | 12/2008 | Heppner | |
| 7,482,707 | B2 | 1/2009 | Wobben | |
| 7,504,742 | B2 | 3/2009 | Wobben | |
| 7,510,350 | B2 | 3/2009 | Ronnkvist | |
| 7,533,505 | B2 | 5/2009 | Henderson | |
| 7,618,217 | B2 | 11/2009 | Henderson | |
| D612,954 | S | 3/2010 | Perko | |
| 7,707,797 | B2 | 5/2010 | Henderson | |
| 7,737,352 | B2 * | 6/2010 | Chang | 84/422.1 |
| 7,786,612 | B2 | 8/2010 | Wobben | |
| 8,505,867 | B2 * | 8/2013 | Conrad | 248/431 |
| 2007/0286684 | A1 | 12/2007 | Heppner | |
| 2010/0257794 | A1 | 10/2010 | Stark | |
| 2011/0217125 | A1 | 9/2011 | Kasprick et al. | |
| 2013/0227897 | A1 * | 9/2013 | Palmer et al. | 52/157 |

* cited by examiner

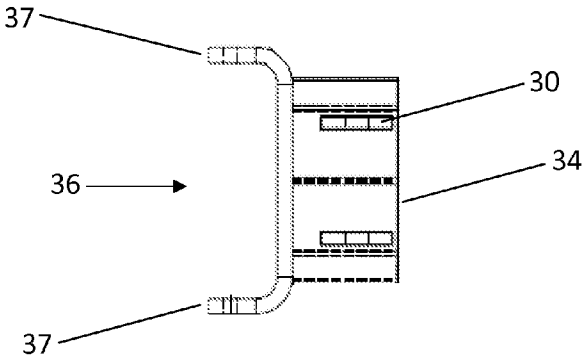
FIG. 8
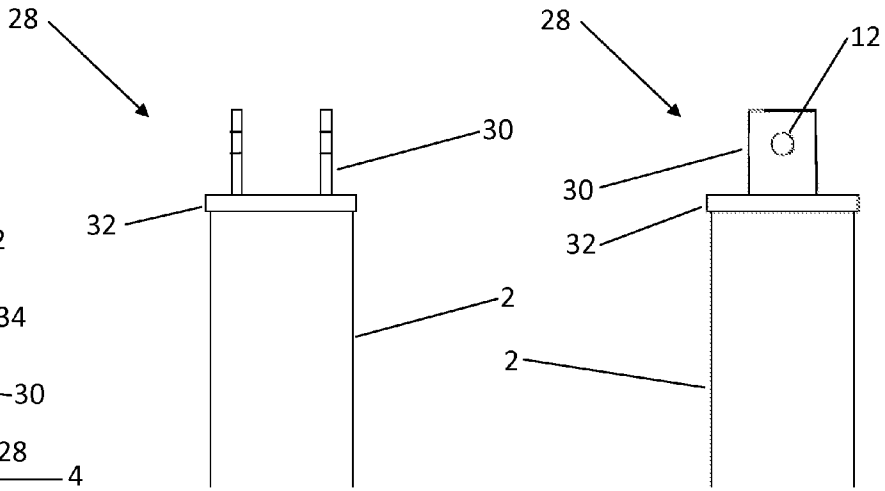
FIG. 10
FIG. 9
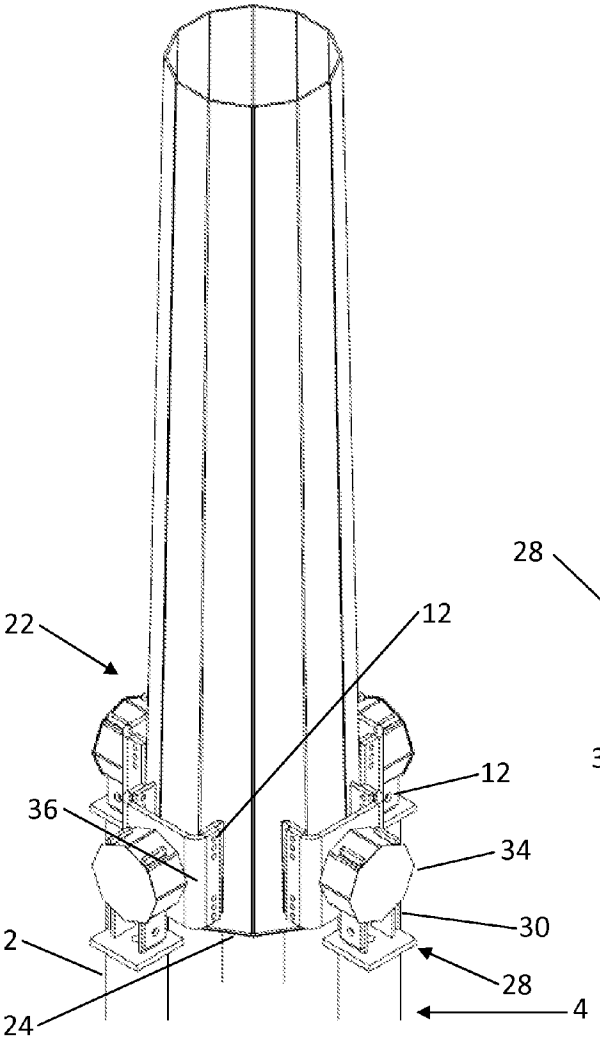
FIG. 7

FOUNDATION SYSTEM FOR ELECTRICAL UTILITY STRUCTURES

CROSS-REFERENCE TO RELATED APPLICATION

This application claims priority under 35 U.S.C. §119, based on U.S. Provisional Patent Application No. 61/605,517, filed Mar. 1, 2012, the disclosure of which is hereby incorporated by reference herein.

FIELD OF THE INVENTION

In general, the present invention relates to a foundation system for electrical utility structures. More particularly, the present invention relates to a structure to be supported at its base, a plate cap which is welded to the base of the structure in order to hermetically seal the structure from the elements to prevent corrosion of the interior of the structure, and multiple helical piers for insertion into the ground that are indirectly attached to the base of the structure by multiple arm members which are attached to the base of the structure and distally connect the helical piers to the base of the structure.

BACKGROUND

In the electrical utilities industry, options for installing electrical utility structures include direct embedment and the use of concrete caissons with anchor bolts. Both of these methods for installing electrical utility structures require significant amounts of time and labor, and they impact the chosen construction site. Direct embedment and anchor bolt foundations require the use of heavy equipment which can lead to an adverse impact on the construction site and expensive installation costs. In both cases, installers must be concerned about what to do with displaced ground material from the construction site. When using concrete caissons with anchor bolts, time must be spent waiting for the concrete to cure and set up before an electrical utility structure can be installed. Neither of these options is sufficient when a strict timeline must be met and minimal site disturbance is required.

SUMMARY OF THE INVENTION

The present invention provides a foundation system for electrical utility structures which minimizes impact on the chosen construction site, minimizes labor and minimizes associated installation costs. The present invention includes a structure that has a base and which is supported at the base by multiple helical piers which are driven into the ground and indirectly attached to the structure base by arm members. The arm members attach to the helical piers at their distal ends by a pin connection or a bolted connection. The arm members may be either elongated plate arms with gussets or pipe spacers for stiffening support or arm members which have polygonal cross-sections. The arm members attach to the base of the structure either by slotted, perpendicularly intersecting thru-plates which protrude from the walls at the base of the structure or by doubler assemblies which are welded to the outer walls at the base of the structure. If doubler assemblies are used to connect the arms to the base of the structure, stiffening rings may also be used in conjunction with the doubler assemblies in order to provide lateral support and resistance to local buckling, punching shear or torsional forces. A pin connection or a bolted connection may be used to attach the arms to the base of the structure using either of the previously described methods.

BRIEF DESCRIPTION OF THE DRAWINGS

FIG. 7 is a front perspective view of polygonal arms attached to the base of the structure using a thru-plate connection for a foundation system for electrical utility structures of the present invention.

FIG. 8 is a plan view of a polygonal arm member for a foundation system for electrical utility structures of the present invention.

FIG. 9 is a front elevation view of a helical pier with a pier top assembly for a foundation system for electrical utility structures of the present invention.

FIG. 10 is a side elevation view of a helical pier with a pier top assembly for a foundation system for electrical utility structures of the present invention.

DETAILED DESCRIPTION OF THE PREFERRED EMBODIMENT(S)

Figure 1:
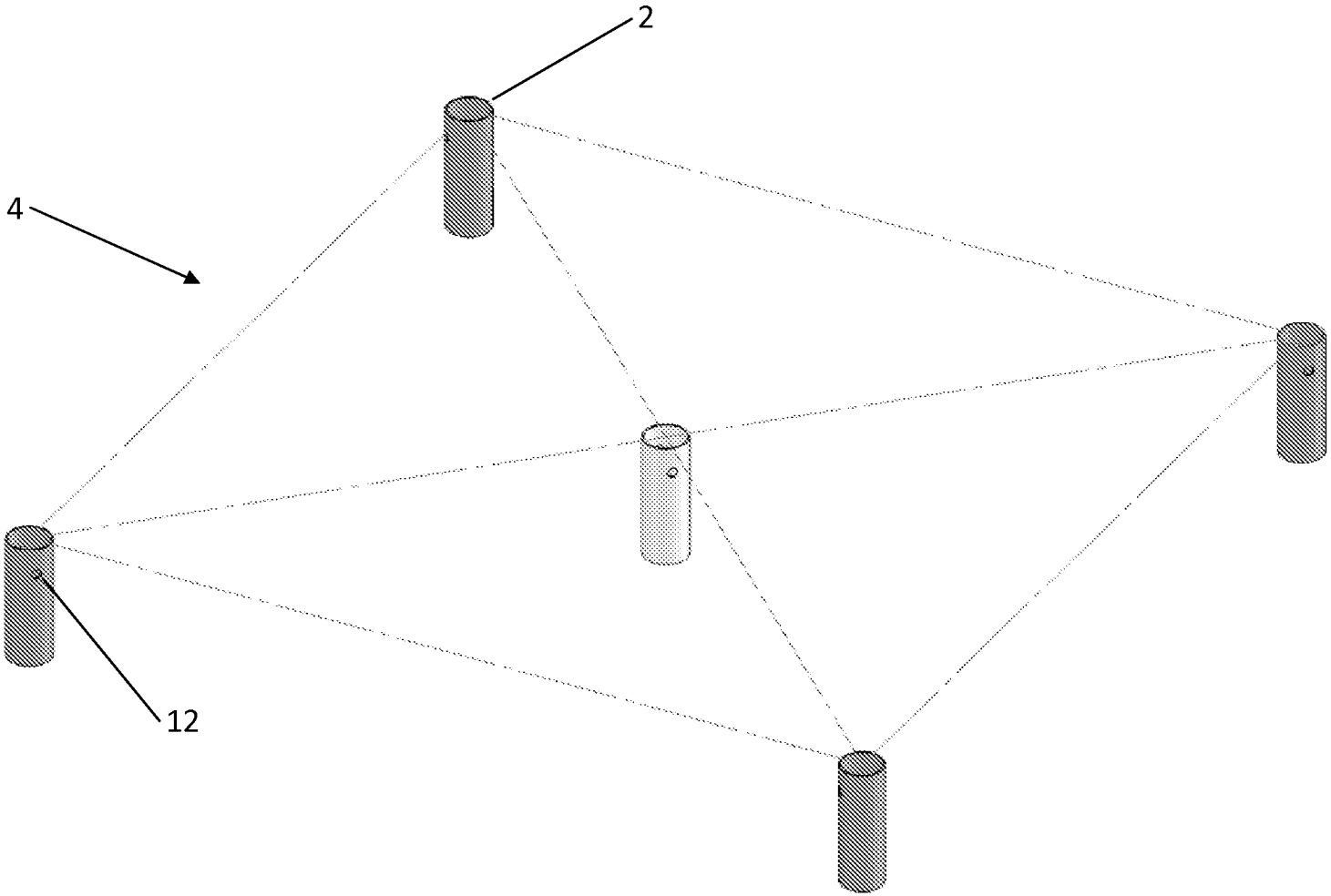
FIG. 1 is a front perspective view of a single pier system for a foundation system for electrical utility structures of the present invention.

The above and other features, aspects and advantages of the present invention will now be discussed in the following detailed description of preferred embodiments and appended claims, which are to be considered in conjunction with the accompanying drawings in which identical reference characters designate like elements throughout the views.

Figure 2:
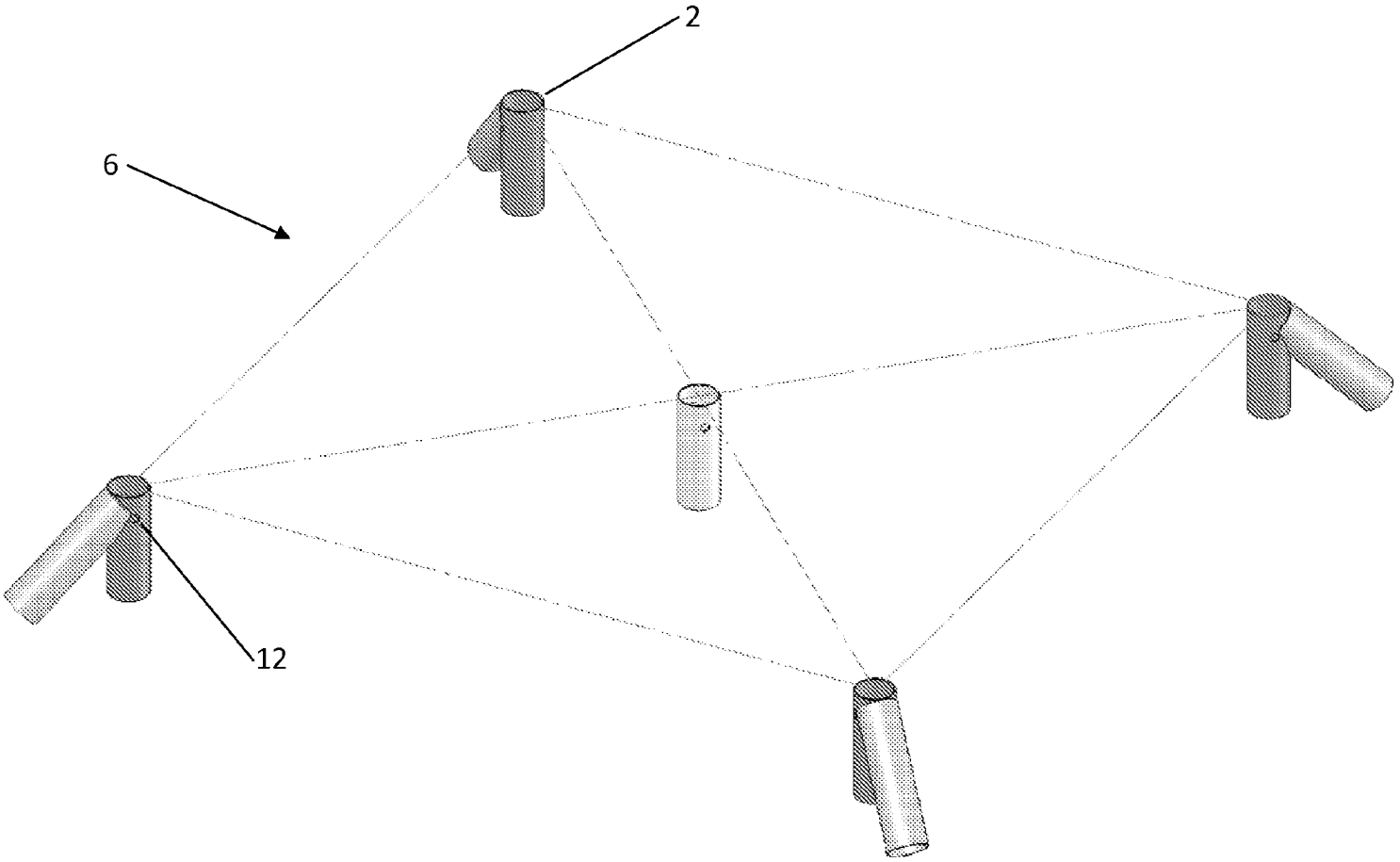
FIG. 2 is a front perspective view of a double pier system for a foundation system for electrical utility structures of the present invention.

Shown in FIG. 1 is a front perspective view of a single helical pier system 4 of the present invention. FIG. 1 illustrates the embodiment of the helical piers 2 embedded in the ground as a square arrangement, with one helical pier 2 at each corner of the square and one helical pier 2 in the center of the square, which may or may not be required and which, if required, would be situated directly beneath an electrical utility structure that is being supported by the helical pier system. The embodiment of the single helical pier system 4 is not limited to a square arrangement, but may be any shape arrangement which is suitable for supporting an electrical utility structure. Also, each helical pier 2 in the single helical pier system 4 is able to be placed at varying angles in the ground in order to counteract forces in different directions. Though a helical pier system is shown in FIG. 1, it is understood that the system may include a variety of micropile and pier systems. FIG. 2 illustrates another embodiment of the helical pier system as a square arrangement, but with two helical piers 2 located at each corner of the square. Depending on the forces which an electrical utility structure is subjected to, some electrical utility structures may require a foundation system with at least a double pier system 6, with the helical piers 2 able to be placed at varying angles in order to counteract forces in different directions. The forces which an electrical utility structure is subjected to would determine the number of helical piers required, and the arrangement of the helical piers would also be dictated by these forces. It is understood that the arrangements shown in FIG. 1 and FIG. 2 may require more or less helical piers to support any given structure, and the arrangement of the piers could be altered as required.

Figure 3:
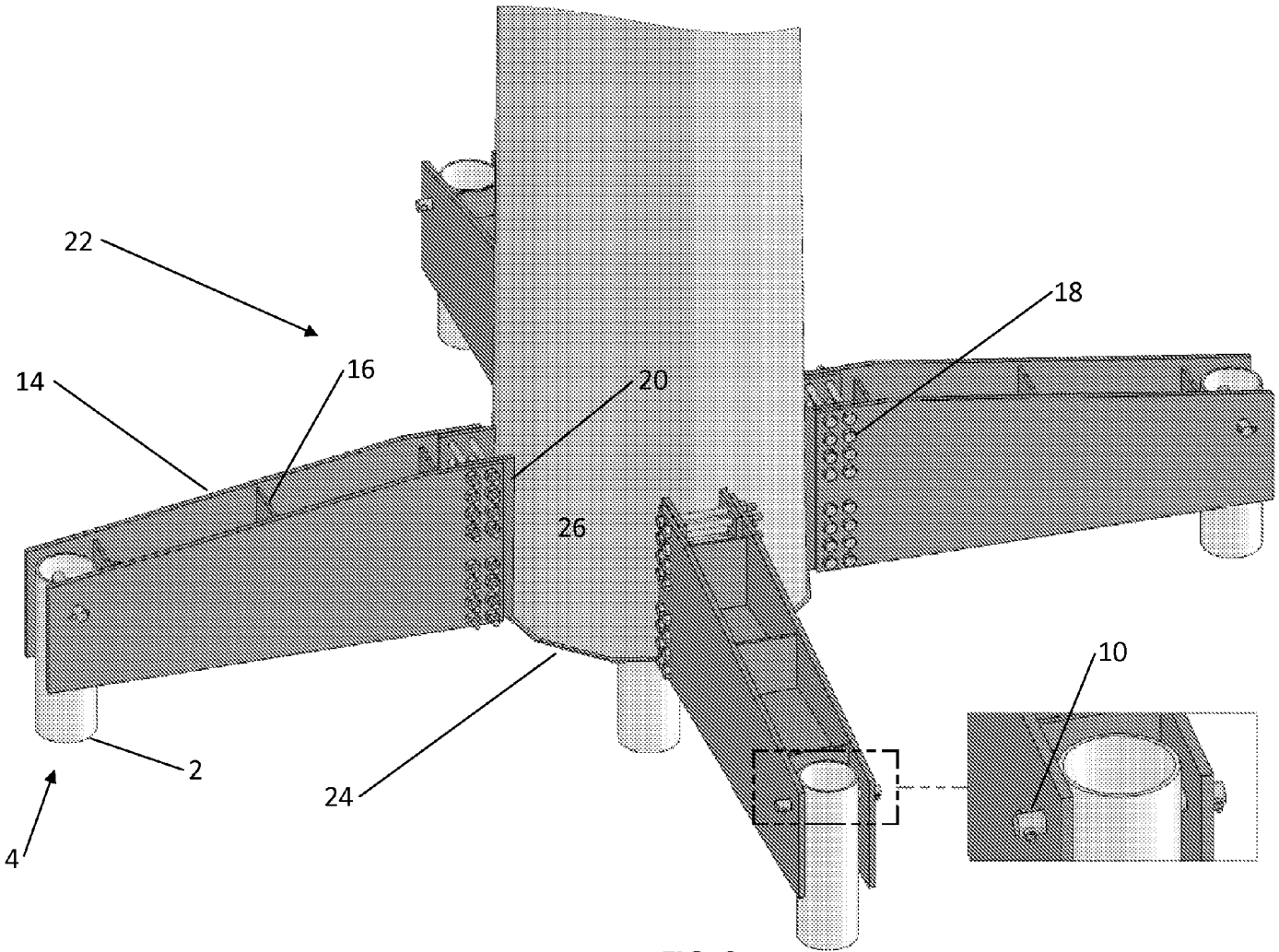
FIG. 3 is a front perspective view of elongated plate arm members attached to the base of the structure using a thru-plate connection for a foundation system for electrical utility structures of the present invention.
Figure 6:
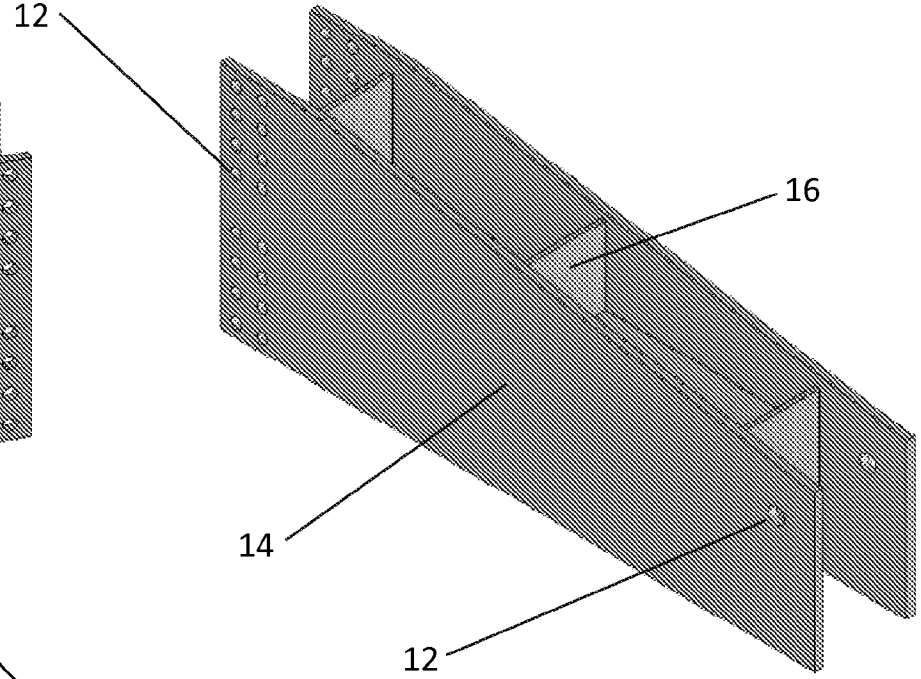
FIG. 6 is a front perspective view of an elongated plate arm member for a foundation system for electrical utility structures of the present invention.

FIG. 3 shows one possible embodiment of the present invention of a foundation system for electrical utility structures. In this embodiment, a single pier system 4 is used to support a base of a structure 22. However, at least a double or triple pier system may be required in some instances. Also, as previously mentioned, though a helical pier system is shown, it is understood that the system may include a variety of micropile and pier systems. In FIG. 3, multiple helical piers 2 have been inserted into the ground and are connected to distal ends of elongated plate arm members 14 by a pin 10 which is axially aligned through an aperture 12, as shown in FIGS. 1 and 2, which is present in the top of the helical piers 2 and which is also present in the distal ends of the elongated plate arm members 14, as is shown in FIG. 6. The elongated plate arm members 14 are formed from multiple plates which are welded together and have gussets 16 welded in between to act as stiffeners and provide lateral support. In FIG. 3, the elongated plate arm members 14 are attached to thru-plates 20 which protrude from walls 26 at the base of the structure 22. The elongated plate arm members 14 attach to the thru-plates 20 in FIG. 3 by a bolted connection 18, but may also attach by a pin connection if preferred.

Figure 4:
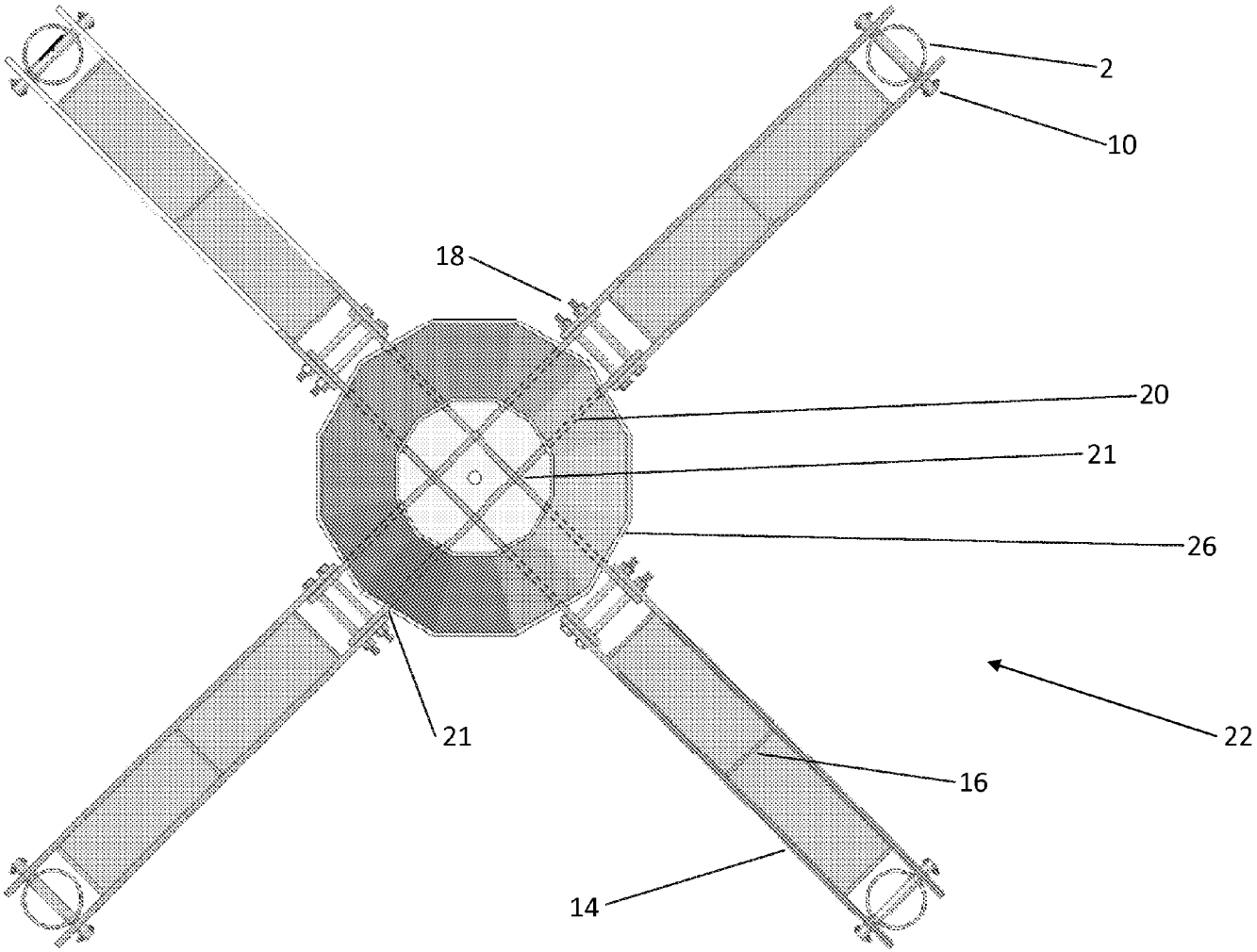
FIG. 4 is a plan view of elongated plate arm members attached to the base of the structure using a thru-plate connection for a foundation system for electrical utility structures of the present invention.
Figure 14:
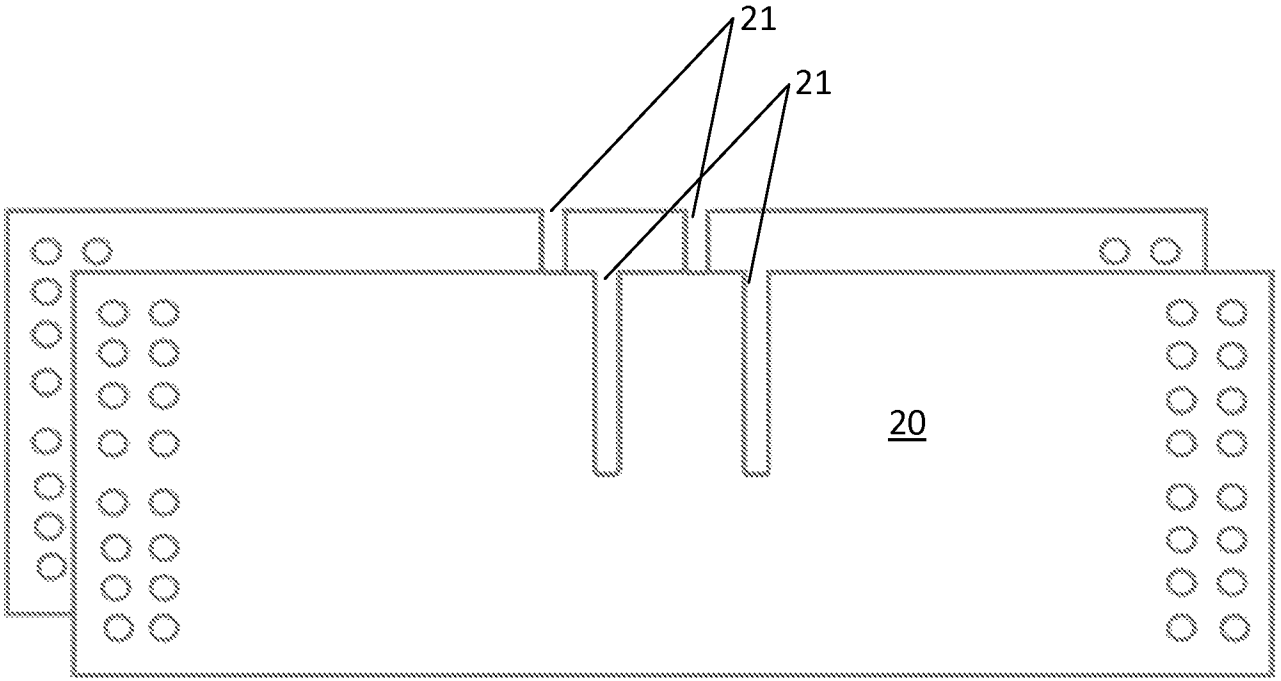
FIG. 14 is a side elevation view of a thru plate with slots for a foundation system for electrical utility structures of the present invention.

Shown in FIG. 4 is a plan view of the same embodiment of the present invention of a foundation system for electrical utility structures as is shown in FIG. 3. The plan view shows the thru-plates 20 intersecting one another inside the base of the structure 22. FIG. 14 shows that the thru-plates 20 are able to intersect one another with the use of slots 21 which are present in each thru-plate 20 at the point of intersection with another thru-plate. Once thru-plates 20 are slotted together in the base of the structure 22, they are welded at the points of intersection. Slots 21 are also cut into the walls 26 of the base of the structure 22 which allows for the thru-plates 20 to protrude from the walls 26. The thru-plates 20 are also welded at the points where they protrude from the slots 21 in the walls 26 of the base of the structure 22.

Figure 5:
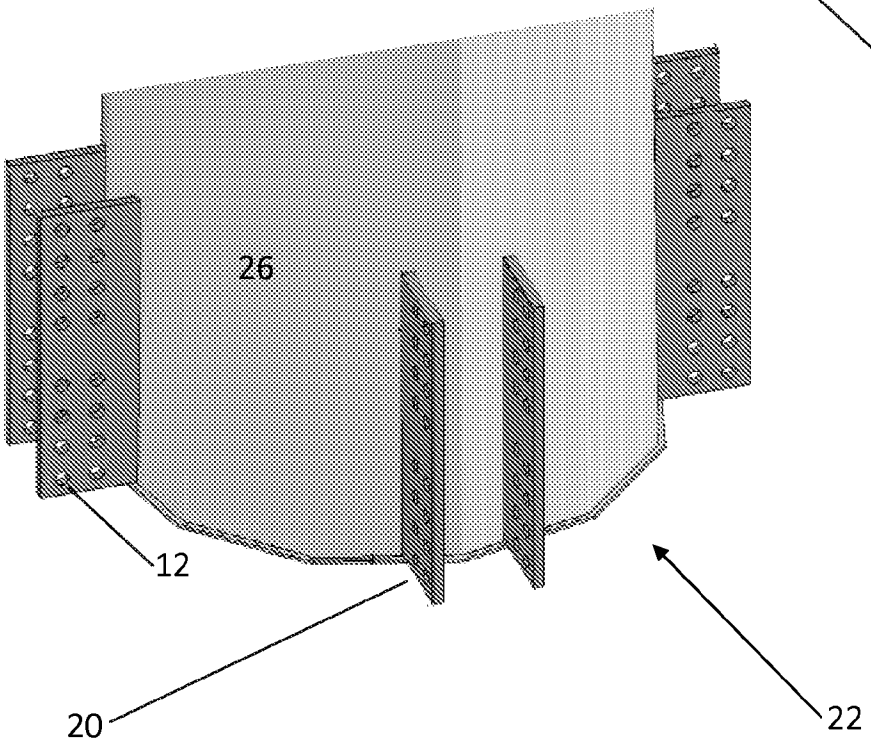
FIG. 5 is a front perspective view of thru-plates at the base of the structure for a foundation system for electrical utility structures of the present invention.

FIG. 5 shows a clear front perspective view of the thru-plates 20 protruding from the walls 26 of the base of the structure 22. It also shows the apertures 12 in the thru-plates 20 which align with the apertures 12 in the elongated plate arm member 14 of FIG. 6, allowing the elongated plate arm member 14 to attach to the base of the structure 22 by either a bolted or a pin connection.

FIG. 7 shows another embodiment of the present invention of a foundation system for electrical utility structures. In FIG. 7, multiple helical piers 2 have been inserted into the ground and are connected to distal ends of polygonal arms 34, that is, arms with polygonal cross-sections. As previously mentioned, though multiple helical piers are shown, it is understood that the foundation system may include a variety of micropile and pier systems. The helical piers 2 connect to the polygonal arms 34 by a pin connection or a bolted connection. For this embodiment, tabs 30 are slotted through and welded to the polygonal arms 34, with the tabs 30 containing an aperture 12. The helical piers 2 have a pier top assembly 28 as is shown in FIGS. 7, 9 and 10. The pier top assembly 28, shown clearly in FIGS. 9 and 10, comprises a plate cap 32 which is welded to the top of the helical pier 2, and two tabs 30 which protrude from and are welded to the plate cap 32. The tabs 30 of the pier top assembly 28 also contain apertures 12 which axially align with the apertures 12 in the tabs 30 which are slotted through and welded to the polygonal arms 34, so that a pin or bolt may be received through the aligned apertures 12.

Shown in FIG. 7 and in a plan view of FIG. 8 is a bracket 36 which is welded to the polygonal arms 34. The bracket 36 allows the polygonal arms 34 to be connected to the thru-plates 20 that are more clearly shown in FIG. 5 with either a bolted or a pin connection by apertures 12 which are contained in the legs 37 of the bracket 36 and apertures 12 which are contained in the thru-plates 20 that can be axially aligned.

Figure 11:
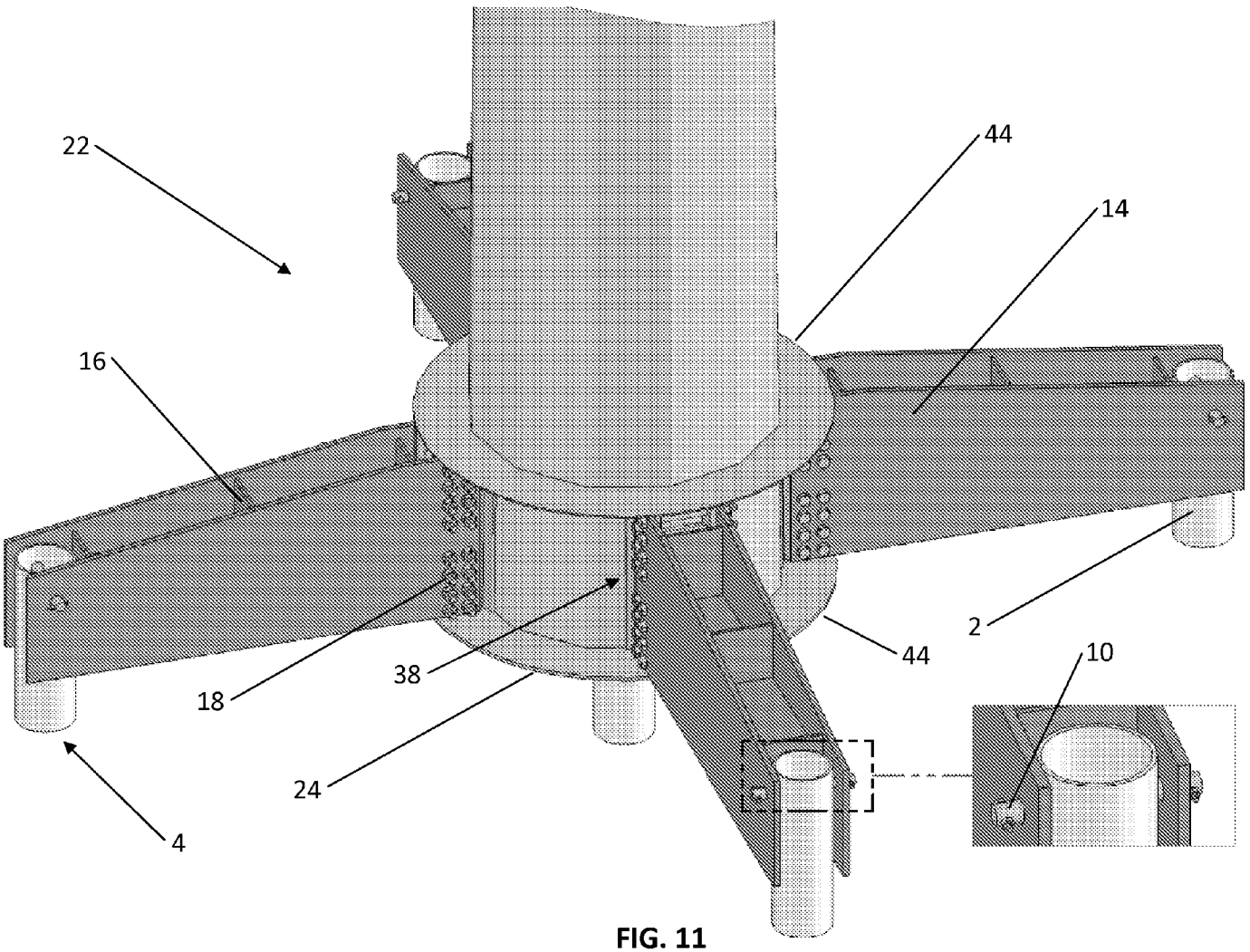
FIG. 11 is a front perspective view of elongated plate arm members attached to the base of the structure using doubler assemblies with stiffening rings for a foundation system for electrical utility structures of the present invention.
Figure 12:
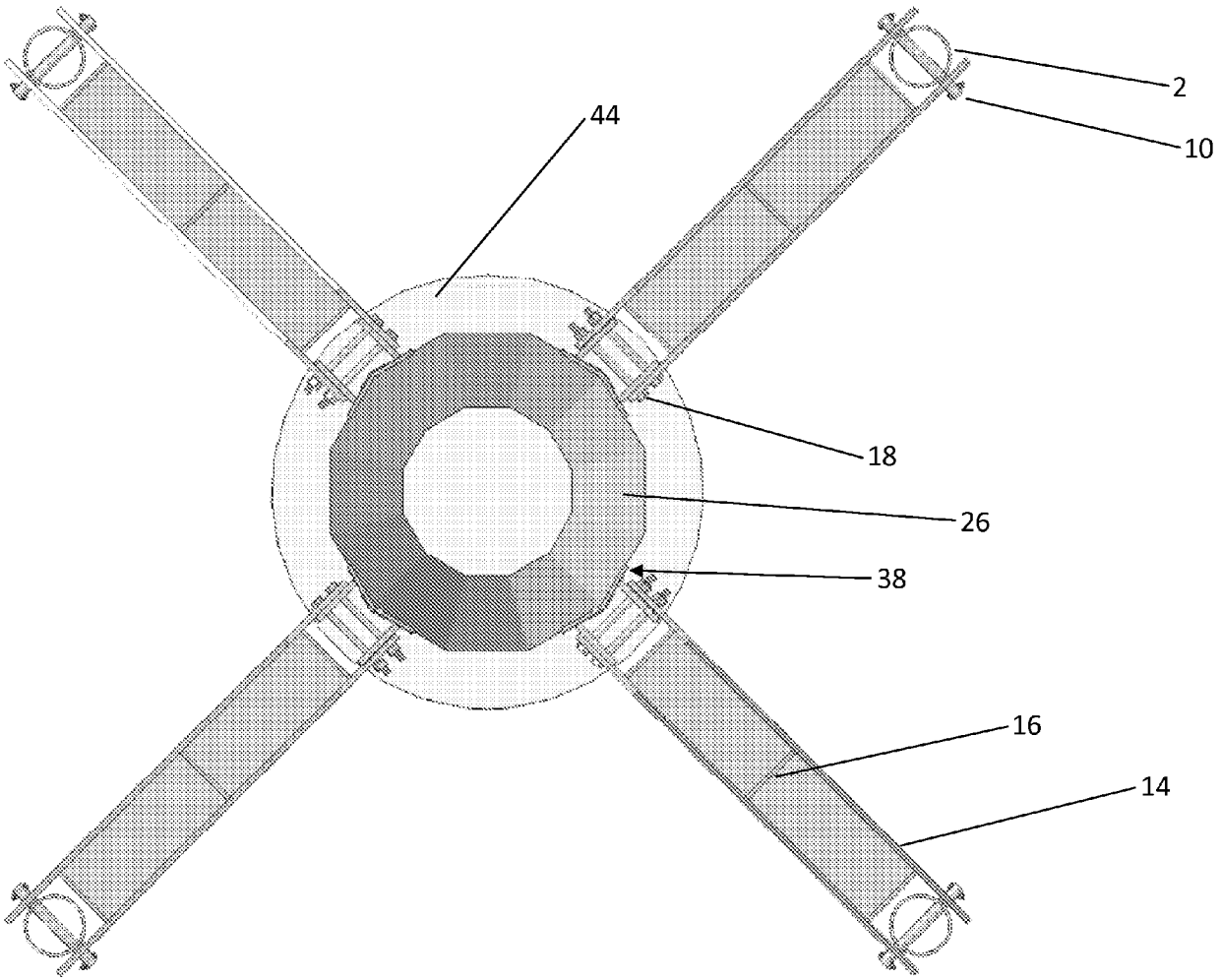
FIG. 12 is a plan view of elongated plate arm members attached to the base of the structure using doubler assemblies with stiffening rings, the top ring removed, for a foundation system for electrical utility structures of the present invention.
Figure 13:
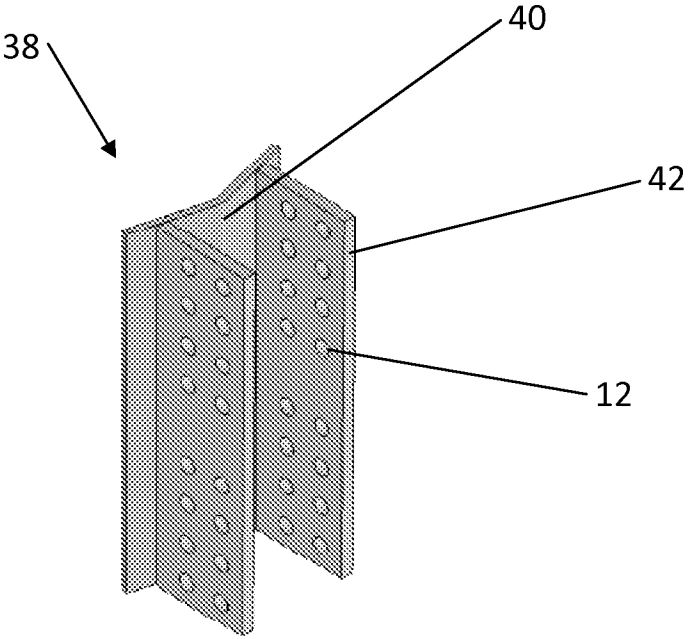
FIG. 13 is a front perspective view of a doubler assembly for a foundation system for electrical utility structures of the present invention.

In FIG. 11, another embodiment of the present invention of a foundation system for electrical utility structures is shown. In FIG. 11, multiple helical piers 2 have been inserted into the ground and are connected to distal ends of elongated plate arm members 14 with a pin 10 which is axially aligned through an aperture 12, as shown in FIGS. 1 and 2, which is present in the top of the helical piers 2 and which is also present in the distal ends of the elongated plate arm members 14, as is shown in FIG. 6. Though a pin is used in FIG. 11 to connect the helical piers to the distal ends of the arm members, it is understood that a bolt may also be used. Instead of attaching to thru-plates 20, such as shown in FIGS. 3 and 4, the elongated plate arm members 14 in FIG. 11 attach to the base of the structure 22 by means of a doubler assembly 38, of which a plan view is shown in FIG. 12 and a close-up view in FIG. 13. As is shown in FIG. 11 and FIG. 12, the doubler assembly 38 is welded to the outer wall of the structure at each location where an arm member is desired. Shown in FIG. 13, at least two extended plates 42 are welded to a doubler plate 40 of the doubler assembly 38, and each of the extended plates 42 contain apertures 12 which align with apertures 12 that are contained in the elongated plate arm members 14. In FIGS. 11 and 12, the elongated plate arm members 14 are shown attached to the doubler assemblies 38 with a bolted connection 18, but as previously explained, a pin connection may be used if this is desired.

Also shown in FIG. 11 are stiffening rings 44. The stiffening rings 44 may be welded above and below the doubler assemblies 38 with the top and bottom rings acting as gussets or stiffeners to the overall connection in order to provide lateral support and resistance to local buckling, punching shear or torsional forces. A plan view of the stiffening ring 44 is shown in FIG. 12 with the top ring removed in order to show the doubler assemblies 38 welded to the outer walls 26 of the structure. Although the arm members shown in FIGS. 11 and 12 are the elongated plate arm members 14, it is understood that polygonal arms 34, such as shown in FIG. 7, may be used to attach to the doubler assemblies 38 in place of the elongated arm members 14. In the case that polygonal arms are used, they may attach to the helical piers 2 with a pin or bolted connection with the pier top assembly, such as shown in FIGS. 7, 8, 9 and 10.

Figure 15:
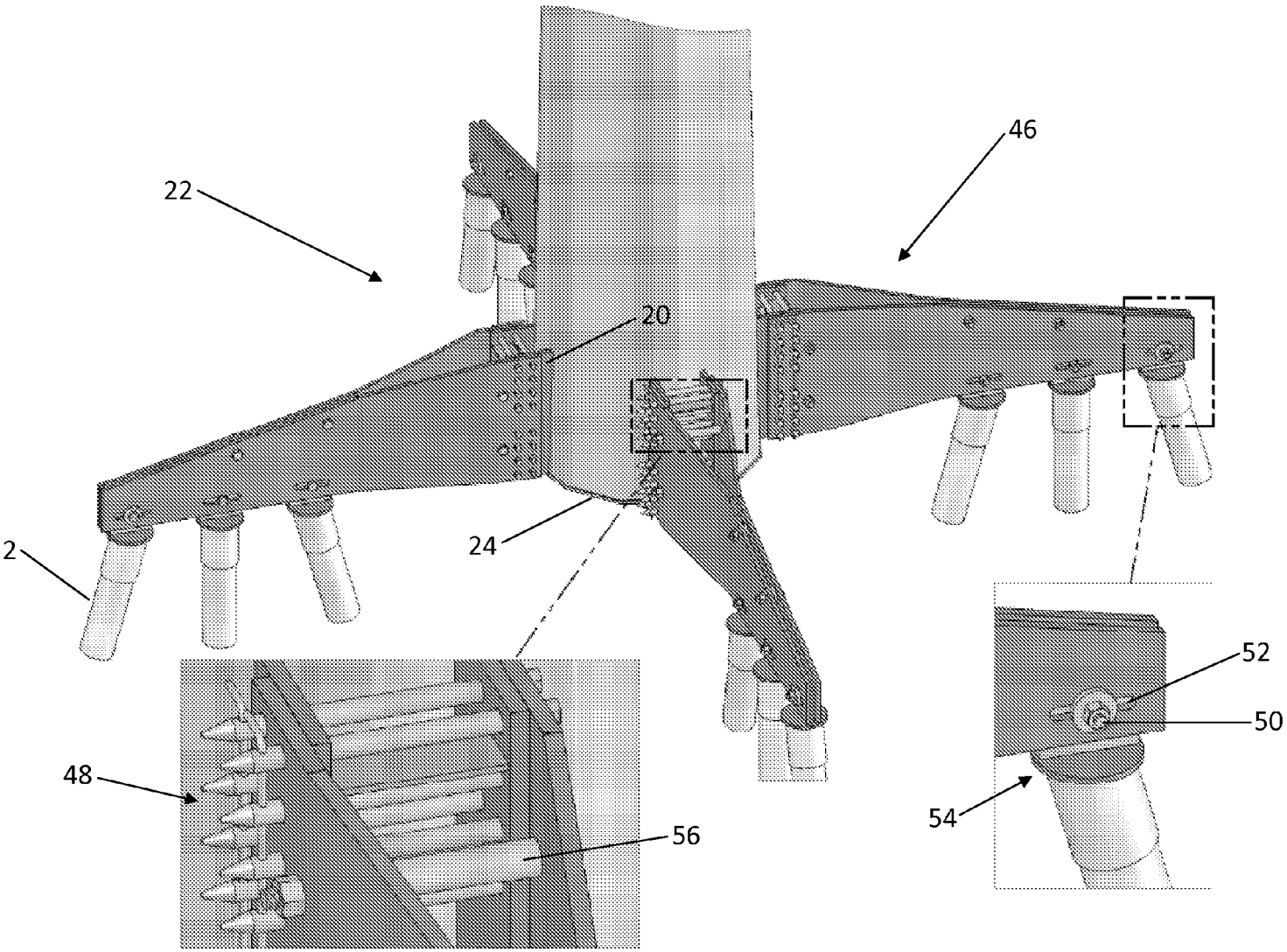
FIG. 15 is a front perspective view of elongated Y-shaped plate arm members attached to the base of the structure using a thru-plate connection for a foundation system for electrical utility structures of the present invention.
Figure 16:
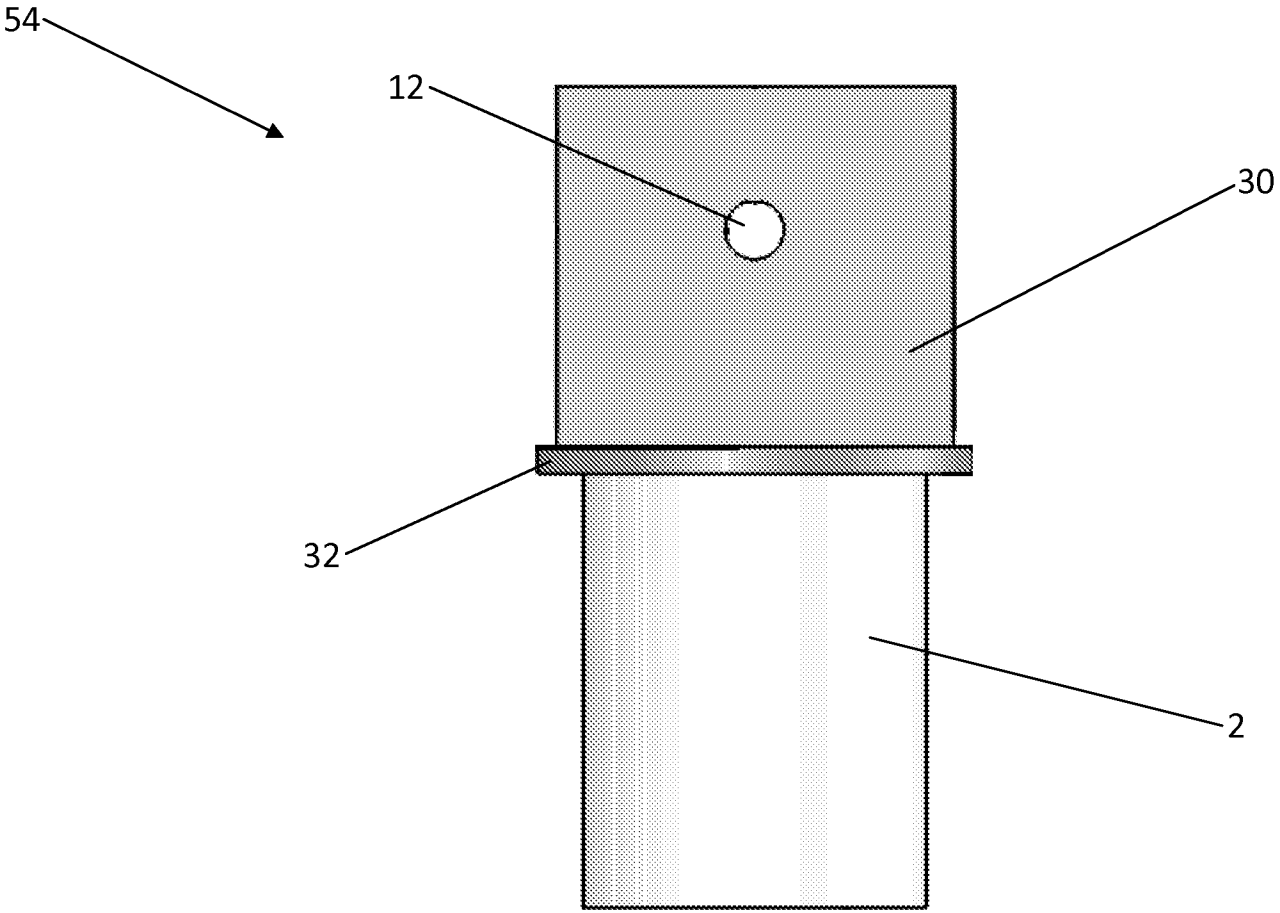
FIG. 16 is a side elevation view of a helical pier with a single tab pier cap assembly for a foundation system for electrical utility structures of the present invention.

Lastly, shown in FIG. 15 is a preferred embodiment of the present invention of a foundation system for electrical utility structures. In this embodiment, a triple pier system is used to support the base 22 of the structure. However, it is understood that more or less helical piers may be required depending on the amount of forces which are exerted on a structure, and it is also understood that though multiple helical piers are shown, the foundation system may include a variety of micropile and pier systems. In FIG. 15, multiple helical piers 2 have been inserted into the ground and are connected to distal ends of elongated plates which mirror one another to form Y-shaped plate arm members 46 that have gussets, or pipe spacers 56, or both, to act as stiffeners and provide lateral support. The distal end, and narrowest portion, of the Y-shaped arms contain axially aligned and opposing slots 52 in each plate of the arm members. A single tab pier cap assembly 54 is located on the top of each helical pier 2. These pier cap assemblies 54, also shown in FIG. 16, comprise a plate cap 32 which is welded onto the top of the helical pier, and a single tab 30 which protrudes perpendicularly upward from the plate cap 32 and which contains an aperture 12. The tabs 30 of each pier cap assembly 54 are inserted between the plates of the distal end, which is the narrowest portion, of the Y-shaped arm members 46 until the apertures 12 of the tabs 30 axially align with the slots 52 in each of the arm members. A bolt is then inserted through the aligned slots of the arms and apertures of the tabs and is secured with a nut and washer. The Y-shaped arm members 46 are shown in FIG. 15 to attach to thru-plates 20 as described previously in FIG. 3, but using a pin connection 48 instead of a bolted connection. However, it is understood that a bolted connection may be used in this embodiment, as is shown in FIG. 3.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A foundation system for electrical utility structures having a base, the foundation system comprising:

an electrical utility structure to be supported at the base;

a plurality of arm members secured to the base;

a plurality of helical piers or micropiles for insertion into the ground;

wherein the helical piers or micropiles are distally attached to the base of the electrical utility structure by attaching to the arm members; and wherein the base of the electrical utility structure contains intersecting and slotted steel thru-plates that extend through slots in walls at the base of the electrical utility structure, and wherein the thru-plates have a plurality of apertures contained within portions of the thru-plates which extend outside of the walls of the base of the electrical utility structure for coupling to the arm members.

2. The foundation system for electrical utility structures of claim 1 wherein the arm members are elongated, parallel plates with gussets or pipe spacers for stiffening support, and wherein the arm members have a plurality of apertures contained in the ends of the parallel plates nearest to the base of the electrical utility structure for aligning with the plurality of apertures contained within portions of the thru-plates which extend outside of the walls of the base of the electrical utility structure, and wherein a plurality of pins or bolts are mutually received through the plurality of apertures which are contained in the arm members and the thru-plates.

3. A foundation system for electrical utility structures having a base, the foundation system comprising:

an electrical utility structure to be supported at the base;

a plurality of arm members secured to the base;

a plurality of helical piers for insertion into the ground which are distally attached to the base of the electrical utility structure by attaching to the arm members;

wherein the helical piers attach to the arm members by a bolted connection; and wherein the base of the electrical utility structure contains intersecting and slotted steel thru-plates that extend through slots in walls at the base of the structure, and wherein the thru-plates have a plurality of apertures contained within portions of the thru-plates which extend outside of the walls of the base of the electrical utility structure for coupling to the arm members.

* * * * *